US008985387B2

(12) United States Patent
Kobayashi

(10) Patent No.: US 8,985,387 B2
(45) Date of Patent: Mar. 24, 2015

(54) BUSINESS CARD CASE

(75) Inventor: Shinichi Kobayashi, Kanagawa (JP)

(73) Assignee: Katoh Electrical Machinery Co., Ltd., Kanagawa (JP)

( * ) Notice: Subject to any disclaimer, the term of this patent is extended or adjusted under 35 U.S.C. 154(b) by 312 days.

(21) Appl. No.: 13/253,729

(22) Filed: Oct. 5, 2011

(65) Prior Publication Data

US 2012/0097698 A1 Apr. 26, 2012

(30) Foreign Application Priority Data

Oct. 22, 2010 (JP) ..... 2010-237481

(51) Int. Cl.
*B65D 83/08* (2006.01)
*B65G 59/00* (2006.01)
*A45C 11/18* (2006.01)

(52) U.S. Cl.
CPC ..... *B65D 83/0829* (2013.01); *A45C 11/182* (2013.01)
USPC ..... 221/154; 221/268

(58) Field of Classification Search
USPC ..... 221/154, 210, 246, 263, 265, 268, 276, 221/279, 280
See application file for complete search history.

(56) References Cited

U.S. PATENT DOCUMENTS

| | | | | | |
|---|---|---|---|---|---|
| 2,472,051 | A * | 5/1949 | Testi | 221/232 |
| 3,114,475 | A * | 12/1963 | Etes | 221/103 |
| 3,827,597 | A * | 8/1974 | Braginetz | 221/232 |
| 4,887,739 | A * | 12/1989 | Parker | 221/232 |
| 4,934,520 | A * | 6/1990 | Okada | 206/37 |
| 5,730,319 | A * | 3/1998 | Gray et al. | 221/259 |
| 6,796,455 | B2 * | 9/2004 | Schmidt | 221/256 |
| 7,093,736 | B2 * | 8/2006 | Maietta et al. | 221/3 |
| 7,308,771 | B2 * | 12/2007 | Memelink | 40/649 |
| 7,946,450 | B2 * | 5/2011 | Gelardi et al. | 221/154 |
| 8,225,634 | B2 * | 7/2012 | Giacomin et al. | 70/456 R |
| 8,397,912 | B1 * | 3/2013 | Chen | 206/379 |

* cited by examiner

*Primary Examiner* — Gene Crawford
*Assistant Examiner* — Kelvin L Randall, Jr.
(74) *Attorney, Agent, or Firm* — Notaro, Michalos & Zaccaria P.C.

(57) ABSTRACT

In order to provide a card case in which cards can be automatically and promptly discharged one by one, the case has a case body capable of accommodating more than one cards inside, a card discharging plate mounted so as to proceed from and retreat into the case body via a card discharging opening provided on a side portion of the case body, with a card being placed on its upper surface, and an elastic piece for movably urging the card discharging plate in one direction.

3 Claims, 15 Drawing Sheets

(a)

(b)

BUSINESS CARD CASE

FIELD OF THE INVENTION

The present invention relates to a business card case or name card case, wherein a plurality of cards are stored and they can be promptly discharged one by one in an automatic manner by pressing an operating button as necessary.

BACKGROUND OF THE INVENTION

Conventionally, business card cases or name card cases have been known in the art, such as those disclosed in JP Registered Utility Model Publication No. 3108210 or JP Utility Model Publication No. S62-63020. In JP Registered Utility Model Publication No. 3108210, a discharging opening of business cards or a name cards (hereinafter called cards) is provided on a storage case for storing a plurality of cards, and the stored cards are lifted upward by lifting means provided on a bottom portion of the storage case using elastic means such as a leaf spring. The card lifted upwardly can be pushed out one by one by inserting a finger into a window portion provided on a cover and by sliding the card via frictional force generated between the finger and the card. In JP Utility Model Publication No. S62-63020, a card case comprises a lifting means as well, and a discharging button member thereof is slidably mounted on a cover; The card can be discharged through a discharging opening by locking an end of a card at the top of the stack using a locking portion provided on the discharging button.

However, business card cases or name card cases provided to date, including those described in JP Registered Utility Model Publication No. 3108210 and JP Utility Model Publication No. S62-63020, wherein cards can be easily discharged, are designed for manual discharging operation of cards. Thus these business card cases or name card cases have a problem that the cards cannot be promptly discharged. Another problem with these card cases is that a card at the top unintentionally protrudes from a case so that it is damaged.

SUMMARY OF THE INVENTION

The invention is made to solve the above-mentioned problem. An object of the invention is provide a business card case or name card case which is thin and space-saving even with an automatic discharging mechanism, wherein cards can be promptly and reliably discharged from a card storage case one by one in an automatic manner by pressing an operating button as necessary, and a satisfactory protection for the cards is assured.

To achieve the above-mentioned object, a business card case or name card case according to the invention is characterized in that it comprises a case body in which a plurality of cards can be stored; a case discharging plate provided so as to be capable of proceeding and retreating with a card being placed on an upper surface thereof via a case discharging opening provided on a side portion of the case body; and an elastic means for movably urging the case discharging plate in one direction; wherein said case body is provided with a plate locking means for locking said card discharging plate retreated inside; and, wherein said plate locking means comprises an operating button partially protruding from said case body and having an engagement hook provided in an operating button insertion hole provided on said case main body so as to be non-rotatable and slidable in an axial direction. an elastic means resiliently provided between an inner bottom portion of said operating button insertion hole and said operating button, and an engagement groove formed on said card discharging plate.

A case body as mentioned above preferably comprises a case main body, a lid body mounted so as to be openable/closable with regard to the case main body and a lid body locking means locking the lid body in a closed state with regard to the case main body. However, its design is not necessarily limited thereto.

Moreover, a case main body as mentioned above preferably comprises a bottom plate and a card accommodating frame mounted on the bottom plate. However, its design is not necessarily limited thereto.

On a case body as mentioned above, a card pressing means is preferably provided for pressing cards accommodated in the case body toward a card discharging plate.

A card discharging plate as mentioned above can be so designed that it discharges cards via a card discharging opening as mentioned above outside a case body as mentioned above by a rotatable movement in a horizontal direction. However, the plate can also be so designed that it linearly proceeds and retreats in a longitudinal direction of the case body or in a direction perpendicular thereto, and not limited to a rotatable movement.

An anti-slip sheet is preferably attached to the entirety or a part of an upper surface side of a card discharging plate as mentioned above.

Under the above-mentioned arrangement of the present invention, the user performs operation for unlocking a plate locking means as mentioned above at the time of discharging cards, which allows a card discharging plate movably urged to rotatably move to be exposed to the outside, with only one card being placed thereon. Thus the user has only to pick out the card, which enables a prompt and reliable operation for discharging cards one by one.

Moreover, since a card discharging plate as mentioned above moves only in a horizontal direction, a drive mechanism for a thickness direction is not necessarily provided. Thus it is possible to provide a space-saving, thin and compact business card case or name card case.

Still further, cards accommodated in a card accommodating frame body will not protrude from the card accommodating frame body, until they are discharged by a card discharging plate as mentioned above. Therefore, protection of cards is satisfactorily assured.

DESCRIPTION OF THE EMBODIMENTS

Figure 1:
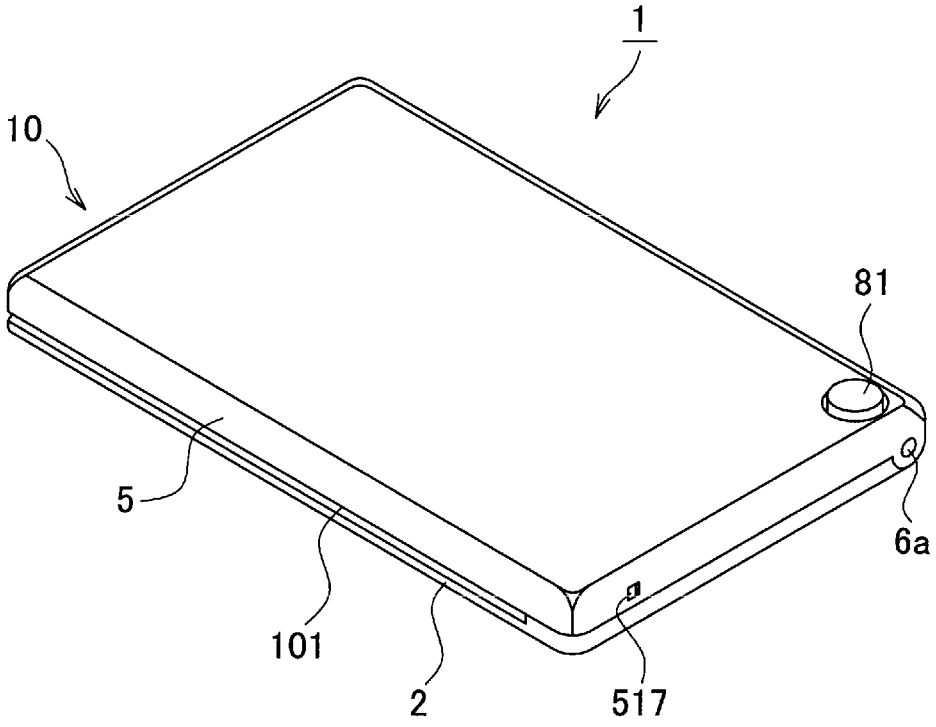
FIG. 1 is a perspective view showing an embodiment of a business card case/name card case according to the invention.

In the following, preferable embodiments of a business card case/name card case (hereinafter called card case) according to the invention will be described in detail, based on the drawings.

FIGS. 1 to 5 show an embodiment of a card case according to the invention.

As shown in the drawings, a card case 1 according to the invention comprises a case body 10 capable of accommodating a plurality of cards M inside. A card discharging opening 101 is provided on a side portion of the case body 10 (see FIG. 1), thus the card case is so designed that a card discharging plate 3 with one card m being placed on an upper surface thereof (see FIGS. 3 and 4) can protrude and retreat between the card discharging opening 101 and case body 10.

A card discharging plate 3 is movably urged by a spring 7 as elastic means which is designed to rotatably move the card discharging plate in one direction from the card discharging opening 101 to the outside of the case body 10. As described below, when a plate locking means 8, which locks the card discharging plate 3 as a whole being accommodated in the case body 10 against an elastic force of the spring 7, is unlocked by pressing an operating button 81, a restoration force of the elastic means (spring 7) allows the card discharging plate 3 to rotatably move in a horizontal direction to the outside of the case body 10.

Figure 3:
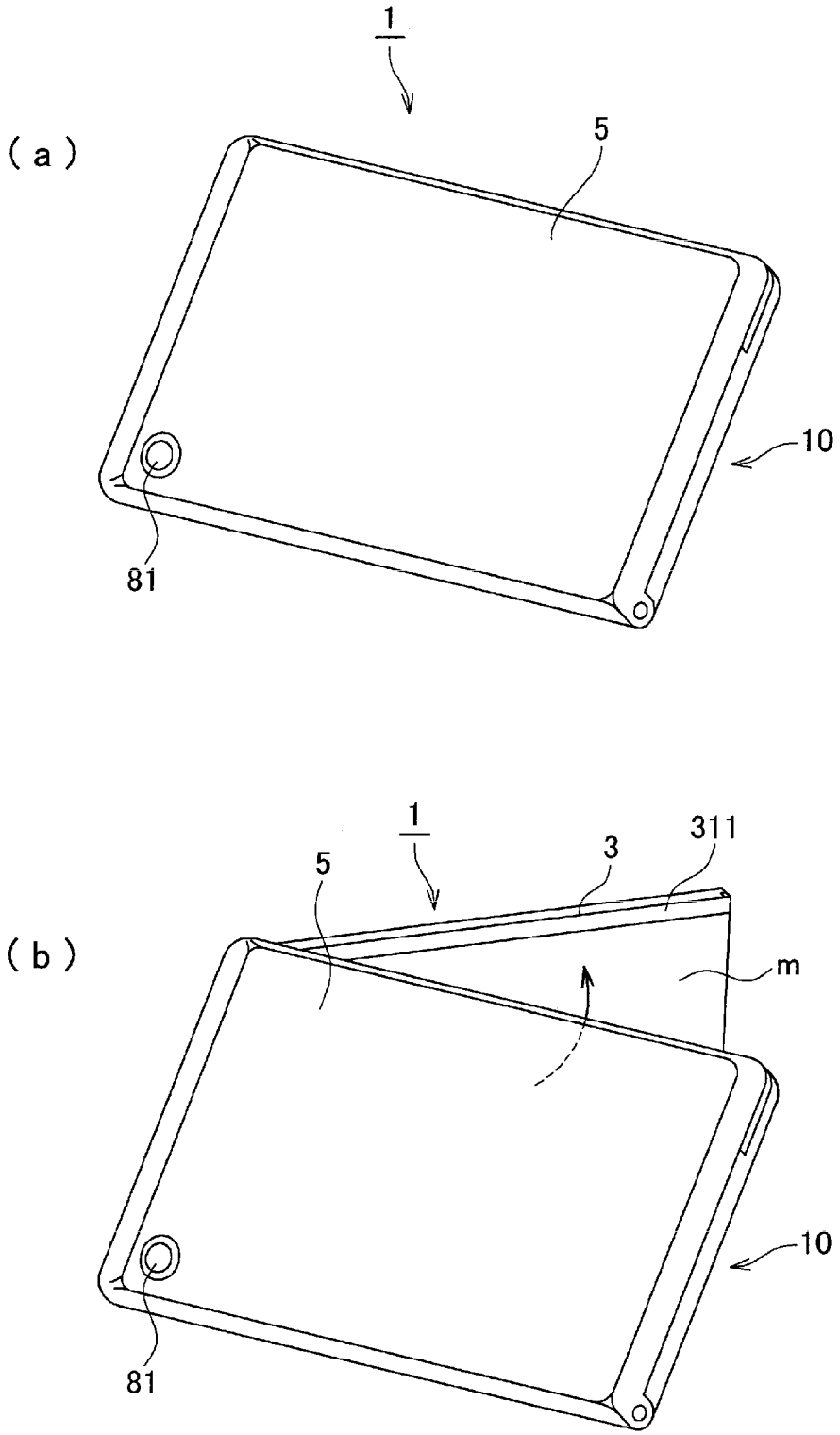
FIG. 3A is a perspective view of a business card case/name card case according to the invention in a closed state as seen from an upper surface side.
FIG. 3B is a perspective view of a business card case/name card case according to the invention as seen from an upper surface side, while a card is discharged.
Figure 4:
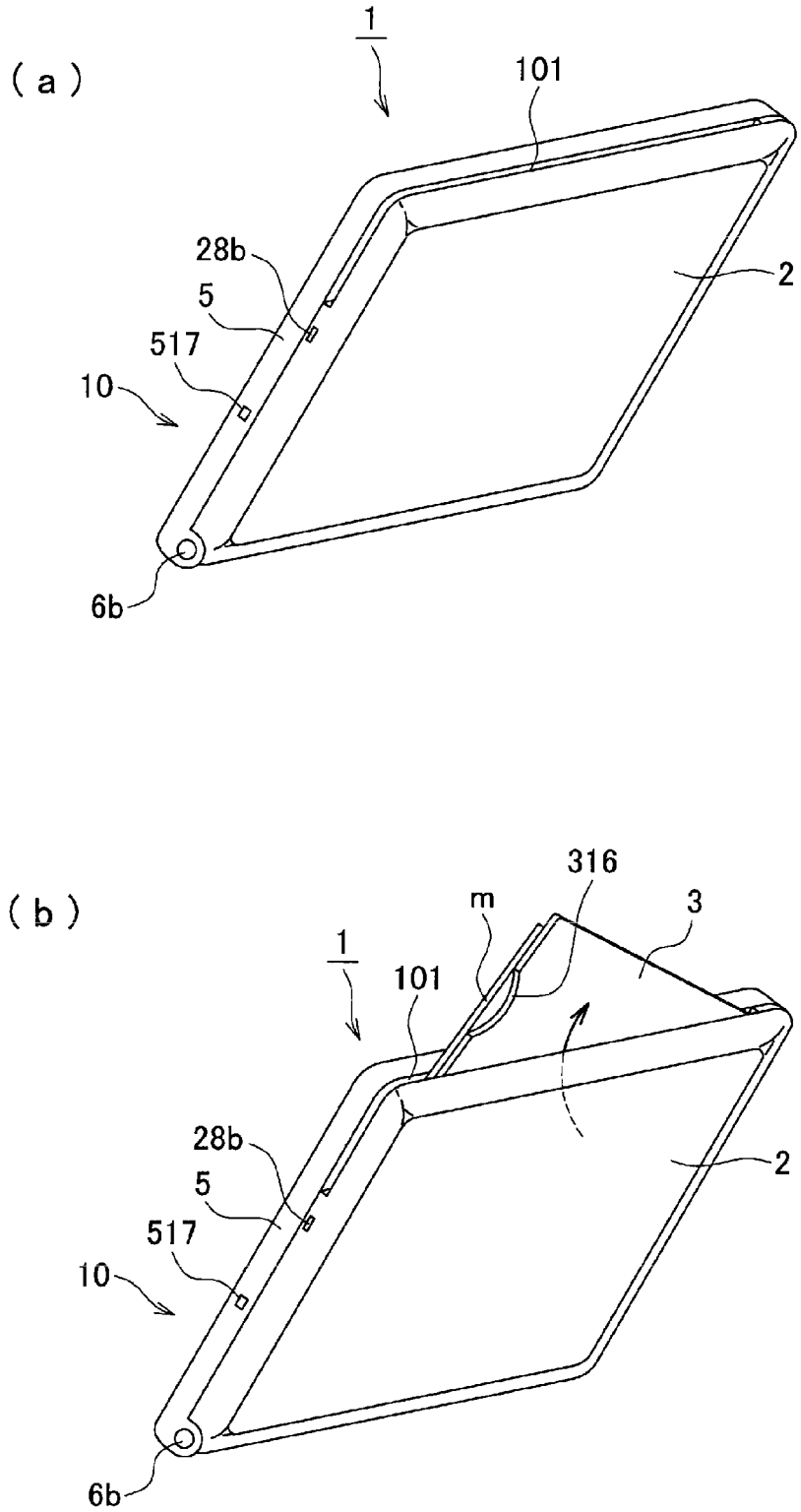
FIG. 4A is a perspective view of a business card case/name card case according to the invention in a closed state as seen from a lower surface side.
FIG. 4B is a perspective view of a business card case/name card case according to the invention as seen from a lower surface side, while a card is discharged.

In other words, a top portion of an operating button 81 protruding from a corner of a lid body 5 is pressed in order to discharge a card; in this manner, a card discharging plate 3 rotatably moves to protrude from a card discharging opening 101 on one side portion of a card case 1, so that one card m on an upper surface of the card discharging plate 3 can be discharged out of a case body 10 to the outside, as shown in FIGS. 3 and 4.

After a card m is removed, a card discharging plate 3 is pushed back into a card case 1, so that the card discharging plate 3 is locked by a plate locking means 8 in a state in which it is accommodated in the card case 1. Thus the card discharging plate 3 restores the state as shown in FIG. 1, and keeps the state until an operating button 81 is pressed for the next time.

Figure 5:
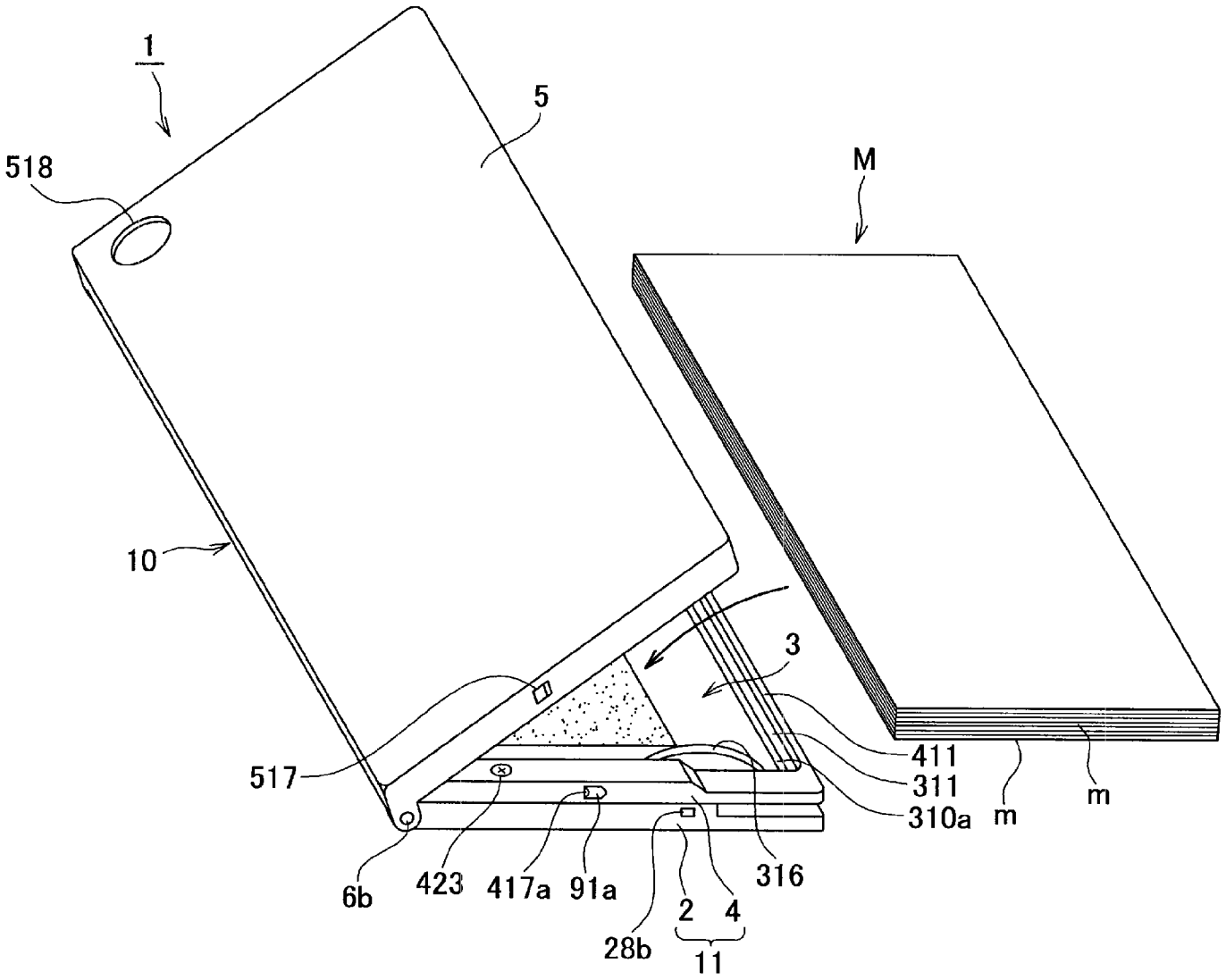
FIG. 5 is a perspective view of a business card case/name card case according to the invention while cards are stored therein.

In an embodiment as shown in drawings, a case body 10 as mentioned above comprises a case main body 11 comprising a bottom plate 2 and a card accommodating frame body 4 mounted on the bottom plate 2, and a lid body mounted so as to be openable/closable with regard to the case main body 11, as shown in FIG. 5.

Figure 2:
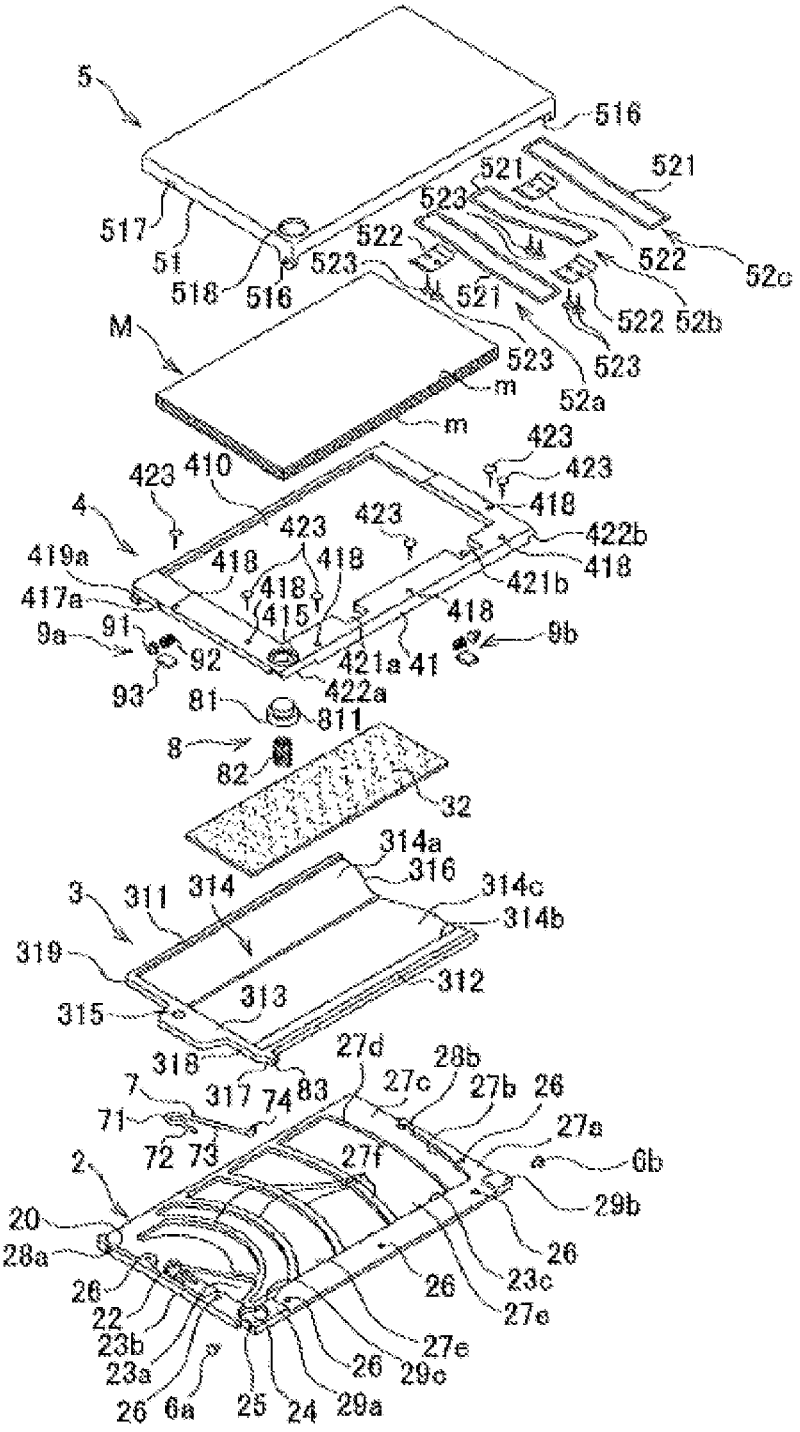
FIG. 2 is an exploded perspective view of a business card case/name card case according to the invention.
Figure 7:
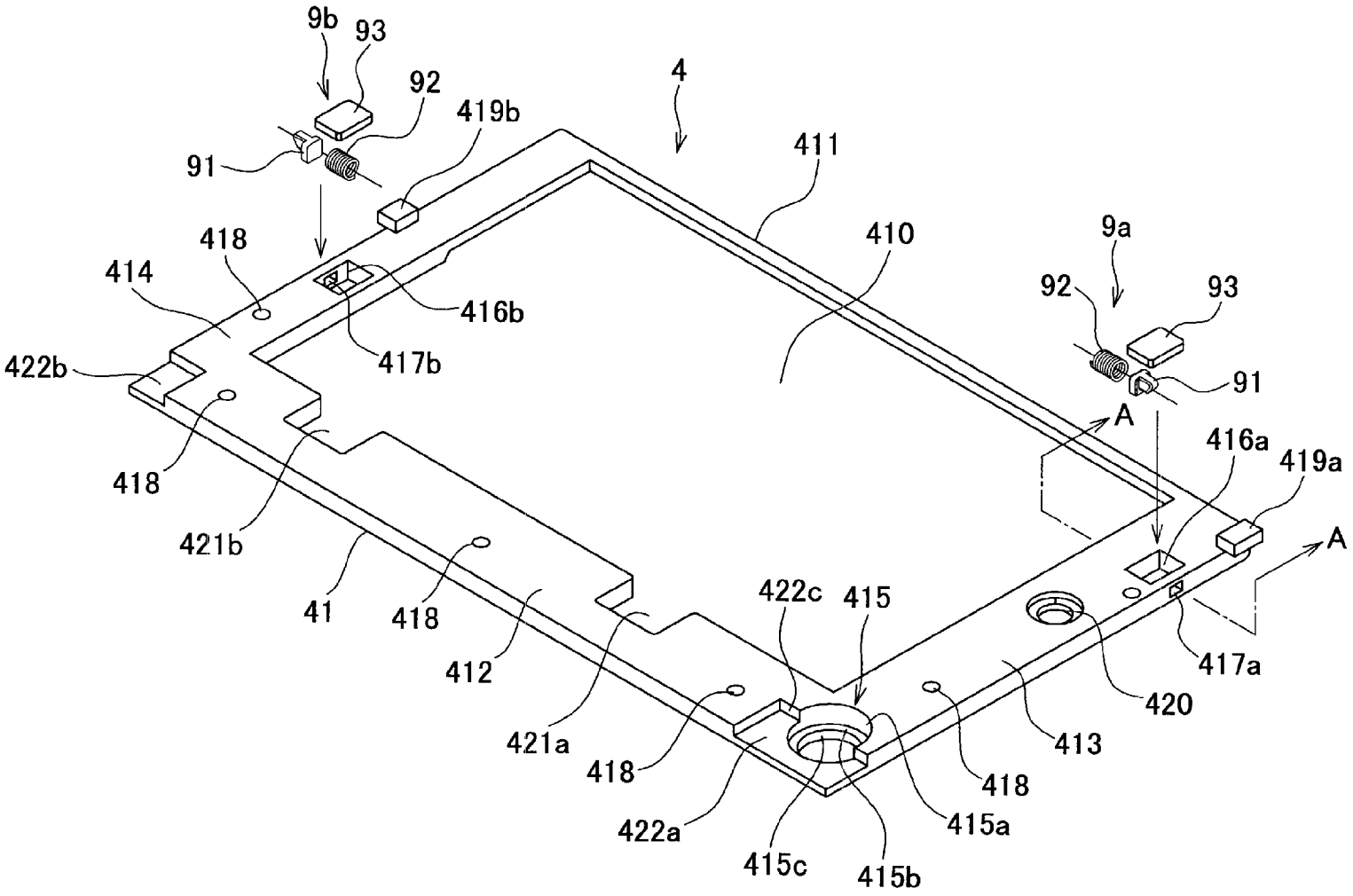
FIG. 7 is a perspective view showing a lower surface side of a card accommodating frame body of a business card case/name card case according to the invention, as well as a lid body locking means thereof mounted thereon, in order to show their structure.

Namely, a card accommodating frame body 4 is fixed via a plurality of retaining screws 423 using a plurality of screw holes 418 opened on the frame as well as a plurality of screw holes 26 opened on a bottom plate 2, as shown in FIGS. 2 and 7. Moreover, a lid body 5 is mounted so as to be openable/closable with regard to the bottom plate 2, by inserting hinge means 6*b*, 6*b* into opening/closing pivotally supporting holes 516 of the lid body 5 as well as lid body mounting pin holes 25 of the bottom plate 2. In the meantime, the hinge means 6*b*, 6*b* are pin-shaped, but not limited thereto. They can be replaced with other known hinge means.

A lid body 5 comprises a lid main body 51 having a top plate portion 510 and circumferential wall portions 511 to 514 provided along four sides thereof, and a plurality of card pressing means 52*a*, 52*b*, 52*c* are mounted on an inner surface of the top plate portion 510.

Circumferential wall portions 512 and 514 on opposing short sides among circumferential wall portions 511 to 514 as mentioned above are respectively provided with opening/closing pivotally supporting holes 516, as described above. A lid body 5 is mounted so as to be rotatably moveable, in other words, openable/closable in a vertical direction with regard to a bottom plate 2 by inserting hinge means 6*b*, 6*b* into the above mentioned opening/closing pivotally supporting holes 516 and lid body mounting pin holes 25 provided on wall surfaces on opposing short sides of a bottom plate main body 21 (see FIG. 2).

An operating button insertion hole 518 is opened on a corner portion of a top plate portion 510 of a lid body 5, so that a top portion 815 of an operating button 81 of a plate locking means 8 as described below can be pressed by finger, while the lid body 5 is closed. In the meantime, opening/closing operations of the lid body 5 can be also carried out in a vertical direction, but sliding in a horizontal direction as in a lid body of a mobile telephone is also acceptable.

Moreover, a lid body 5 uses lid body locking means 9*a*, 9*b* locking the lid body in a closed state with regard to a case main body as mentioned above to exclude unintentional opening operations in the embodiment shown in drawings.

Figure 8:
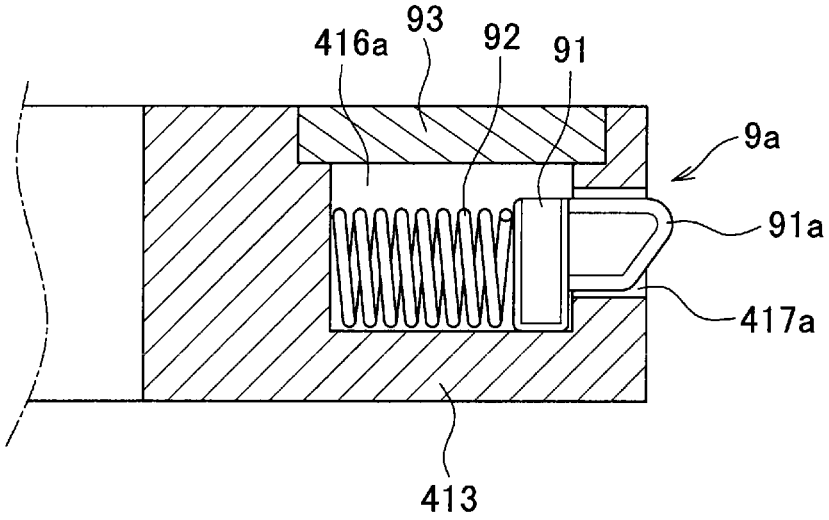
FIG. 8A is an enlarged cross sectional view partly cut away along a line A-A of FIG. 7, for illustrating a lid body locking means of a business card case/name card case according to the invention.
FIG. 8B is an enlarged perspective view of one of engagement projecting pieces of a lid body locking means, for illustrating a lid body locking means of a business card case/name card case according to the invention.
Figure 8:
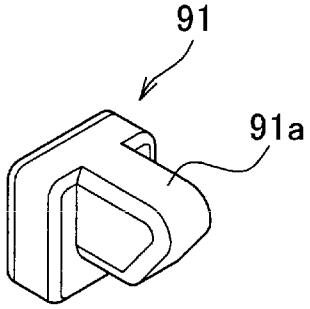

In other words, each of circumferential wall portions 512 and 514 on opposing short sides as mentioned above is provided with an engagement hole 517, and tips of engagement projecting pieces 91 of lid body locking means 9*a*, 9*b* (see FIGS. 2, 7 and 8. In the meantime, FIG. 7 is a perspective view showing a lower surface side of a card accommodating frame body 4) assembled in the frame of the card accommodating frame body 4 are fitted into the engagement holes 517, so that a lid body 5 is retained in a closed state.

Lid body locking means 9*a*, 9*b* since both are of an identical structure, only the structure of one lid body locking means 9*a* is shown in FIG. 8) comprises an engagement projecting piece 91, a compression spring 92 and a pressing lid 93 (see FIGS. 7 and 8). The engagement projecting piece 91 and the compression spring 92 are accommodated into a component accommodating holes 416*a*, 416*b* formed on a first short-side frame 413 and a second short-side frame 414 of a card accommodating frame body 4. An opening of this component accommodating hole is so designed that it is covered with the pressing lid 93. Namely, a convex portion 91*a* (see FIG. 8) of the engagement projecting piece 91 is so placed that the engagement projecting piece 91 is pressed by the compression spring 92 from backside, with a part thereof protruding from a projecting holes 417*a*, 417*b* opened on a side wall of the component accommodating holes 416*a*, 416*b*; here the pressing lid 93 is mounted on the opening of the component accommodating holes 416*a*, 416*b* to cover the opening. The end of the convex portion 91*a* of the engagement projecting piece 91 is slightly rounded, as shown in FIG. 8.

In this manner, when a lid body 5 is closed, a convex portion 91*a* of an engagement projecting piece 91 is fitted into an engagement hole 517 of the lid body 5, so that the lid body 5 is locked in a closed state. When a lid body 5 is opened, engagement projecting pieces 91 are disengaged from engagement hole 517 by simultaneously pressing portions of the engagement projecting pieces 91 protruding from the projecting holes 417*a*, 417*b* using finger, so that opening operation of the lid body 5 is possible.

Figure 6:
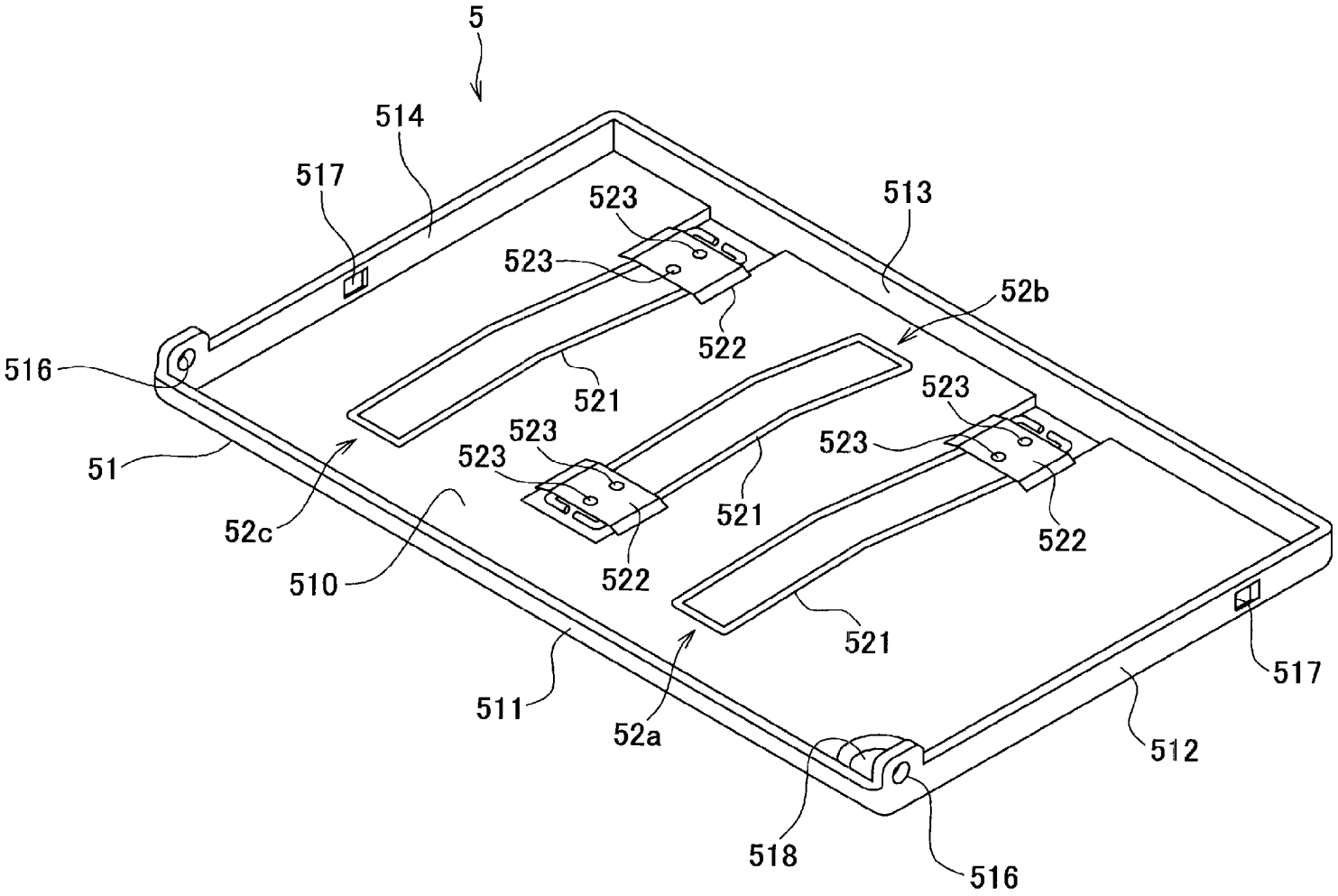
FIG. 6 is a perspective view showing a card pressing means mounted on an inner surface of a lid body of a business card case/name card case according to the invention.

Card pressing means 52*a*, 52*b*, 52*c* are mounted on an inner surface of a top plate portion 510 constituting a portion of a case body 10, as described above (see FIGS. 2, 6), and are so designed that they press cards M stored in the case body 10 toward a card discharging plate 3. Each of the card pressing means 52*a*, 52*b*, 52*c* comprises a spring 521 and a mounting plate 522 fixing an end thereof to the top plate portion 510 of the lid body 5, and is so designed that it presses from above a plurality of cards M stored in a card accommodating frame body 4 on the free end side of the spring 521, and in this manner the lowest layer of the cards are smoothly introduced into a recess 314 as described below on an upper surface of a card discharging plate 3. The mounting plate 522 is fixed via screws 523 on an inner surface of the top plate portion 510. The card pressing means 52*a*, 52*b*, 52*c* can be also mounted on a bottom portion of a case main body 11, and the mounting position thereof is not limited.

A card accommodating frame body 4 as mentioned above consists of a frame main body 41, a central portion thereof being a hollow portion 410 of a size substantially equal to an ordinary card, as shown in FIGS. 2 and 7; in this hollow portion 410, approximately seven to sixteen cards M can be accommodated.

An outer long-side frame 411 of a card accommodating frame body 4 forms a long side facing a card discharging opening 101 as mentioned above, and notch concave portions 421*a*, 421*b* for protecting free ends of springs 521 of card pressing means 52*a* and 52*c* as mentioned above from displacement in accordance with number of accommodated cards are formed on an inner long-side frame 412 opposing this outer long-side frame 411.

Stepped convex portions 419*a* and 419*b* respectively formed on first and second short-side frames 413, 414 of a card accommodating frame body 4 are convex portions for compensating a height difference between an upper step surface 27*a* and a lower step surface 27*c* of a bottom plate 2 as described below (see FIG. 2 and FIG. 10), and these stepped convex portions are so designed that they are respectively fitted into stepped convex portion insertion holes 28*a*, 28*b* opened on circumferential walls of the bottom plate 2. Narrowing of a card discharging opening 101 and block to the movement of a card discharging plate 3 can be prevented by providing the stepped convex portions 419*a* and 419*b*.

Moreover, a pivot head portion receiving hole 420 formed on a first short-side frame 413 of a card accommodating frame body 4 is a hole for receiving a pivot for pivotally supporting a card discharging plate 3 as mentioned above in a manner such that the card discharging plate can rotatably move.

Figure 15:
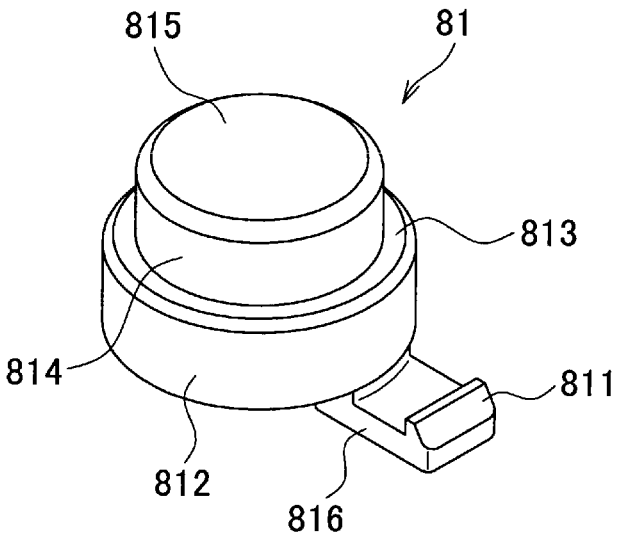
FIG. 15 is an enlarged perspective view of an operating button of a plate locking means of a card discharging plate of a business card case/name card case according to the invention.

Still further, an operating button insertion hole 415 is formed at a corner portion where an inner long-side frame 412 and a first short-side frame 413 of a card accommodating frame body 4 cross, and the operating button insertion hole allows a top portion of an operating button 81 of a plate locking means 8 to pass through. The operating button insertion hole 415 comprises a large diameter portion 415*a*, a stepped stopper 415*b* and a small diameter portion 415*c*, wherein a large diameter portion 812 of the operating button 81 as shown in FIG. 15 is fitted into the large diameter portion 415*a*, a stepped portion 813 of the operating button 81 comes into contact with the stepped stopper 415*b*, and a small diameter portion 814 of the operating button 81 is fitted into the small diameter portion 415*c*. As described below, the operating button 81 is urged upward by an elastic means (compression spring) 82, but its limit position in an upward movement is restricted by the above-mentioned stepped stopper 415*b* of the operating button insertion hole 415.

Still further, positioning concave portions 422*a*, 422*b* are formed on a lower surface in vicinity of both ends of an inner long-side frame 412 of a card accommodating frame body 4, and they are so designed that they enable an exact alignment of a bottom plate 2 and the card accommodating frame body 4 by fitting them with positioning convex portions 29*a*, 29*b* formed at corresponding positions of the bottom plate 2.

Still further, when a bottom plate 2 is fixed to a card accommodating frame body 4 by alignment as above stated, a design is made in a manner such that a gap is formed between a side surface 29*c* of a positioning convex portion 29*a* (as mentioned above) of a bottom plate 2 and a side surface 422*c* facing a positioning convex portion 422*a* of the card accommodating frame body 4. A detent projecting portion 816 of an operating button 81 is fitted into the gap so as to prevent the operating button 81 from rotating around the axis.

A card discharging plate 3 (see FIG. 2, 9), a principal component of the invention, is so designed that it rotatably moves in a horizontal direction in order to bring cards out of a case body 10 as mentioned above via a card discharging opening 101.

In an embodiment shown in the drawings, a card discharging plate 3 is mounted by inserting a pivot 22 provided on one short side of a bottom plate 2 into a pivotally supporting hole 315 on one short side of the card discharging plate 3, in a manner such that it can rotatably moves with regard to the bottom plate 2, around a central point of the pivot 22 (therefore, this is also a central point of the pivotally supporting hole 315). The card discharging plate 3 is further urged by a spring 7 as elastic means attached to a root portion of the pivot 22 so as to rotatably move in one direction from a retreated position to an advanced position. In the meantime, an elastic means such as a torsion coil spring, an extension coil spring, a compression coil spring and others can serve as spring 7.

In other words, a card discharging plate 3 is mounted so that it can rotatably move around a pivot 22 with regard to a bottom plate 2, in a horizontal direction along a main flat surface of the card discharging plate 3 from a retreated position, wherein it totally overlaps a bottom plate 2, to an advanced position, wherein at least an edge portion thereof on a card discharging side is exposed to the outside with regard to an edge portion of the bottom plate 2.

A card discharging plate 3 is so designed that a recess 314 on an upper surface thereof can accommodate cards one by one when it is placed at a retreated position, while one of the cards can be easily discharged by the user when it is placed at an advanced position for discharging operation.

Figure 9:
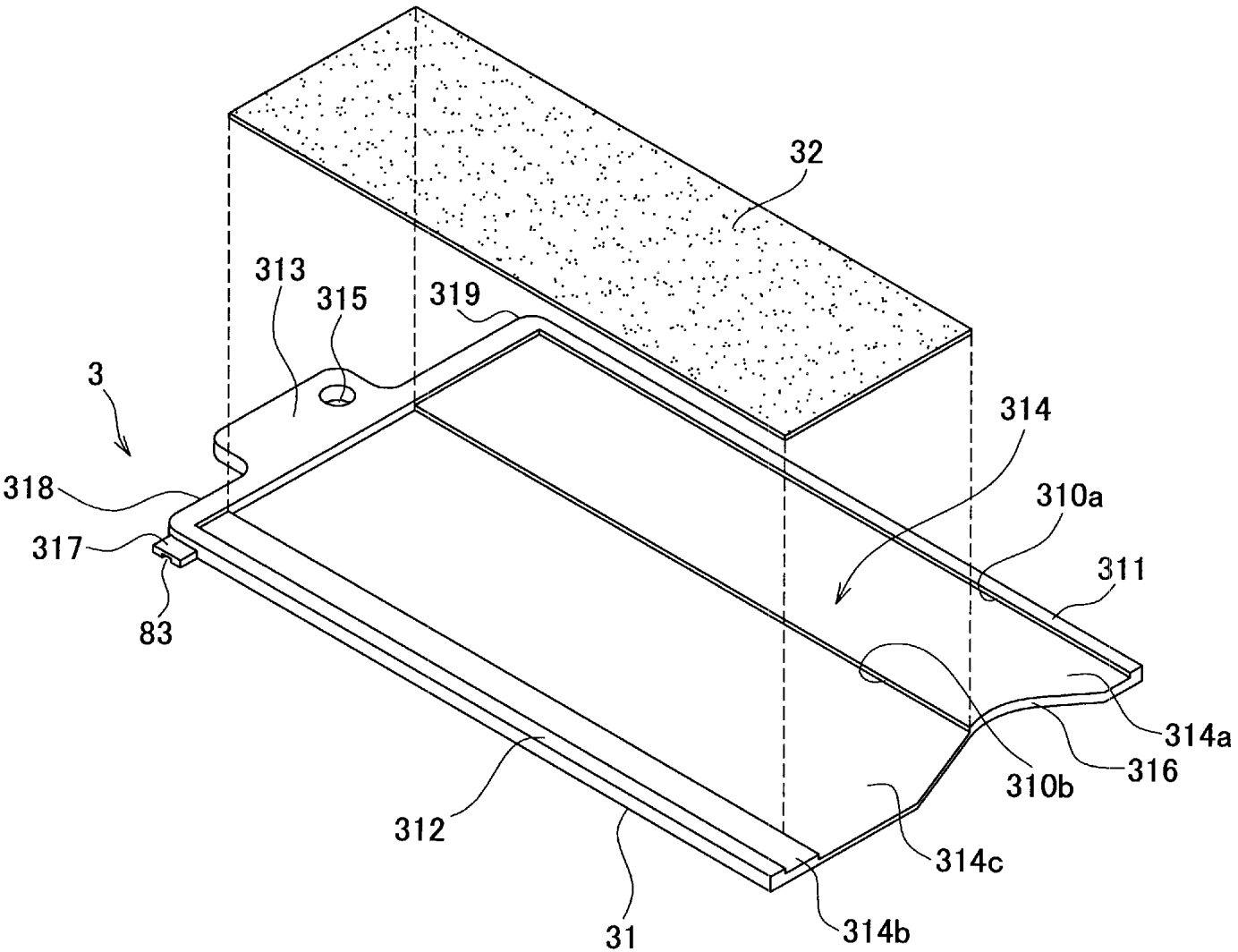
FIG. 9 is a perspective view of structure of a card discharging plate of a business card case/name card case according to the invention.

In other words, an outer long-side upper step surface 311, an inner long-side upper step surface 312 and short-side upper step surface 313 are formed on an identical plane on an upper surface of a card discharging plate 3 along the three sides thereof, as shown in detail in FIG. 9; furthermore, middle step surfaces 314*a*, 314*b* one step lower than these are formed by first stepped portions 310*a*, and a lower step surface 314*c* still one step lower than these is formed by second stepped portions 310*b*. An anti-slip sheet 32 made of felt and others is attached to the lower step surface 314*c*, so that it prevents the cards brought into a recess 314 from protruding or dropping out by a centrifugal force accompanied by a rotatable movement of the card discharging plate 3 in a card discharging operation. Therefore, an upper surface of the anti-slip sheet 32 as attached is preferably set at a height slightly higher than that of the middle step surface 314*a*. Various materials other than felt can serve as anti-slip sheet 32. Besides the use of an anti-slip sheet 32, the top surface of the card discharging plate 3 itself can be also provided with fine irregularities, so that it has an anti-slip effect.

Moreover, first stepped portions 310*a* are set so as to have a step height equal to or slightly lower than the thickness of one card to be discharged. This is because a height higher than the thickness of one card causes the second lowest card to stop at an edge of a first stepped portion 310*a*, which prevents from a smooth discharging operation.

In the meantime, a notch 316 for facilitating a grasping operation of a card is formed on a short side opposite to the side provided with a pivotally supporting hole 315. In an embodiment shown in FIG. 9, a card discharging plate 3 rotatably moves so that a predetermined area including a long side with an outer long-side upper step surface 311 as well as a short side with the notch 316 is exposed to the outside, as shown in FIGS. 3B and 4B.

In the meantime, a projecting portion 317 with an engagement groove is provided on a corner portion on a side provided with a spring working end surface 318 of a card discharging plate 3, and an engagement groove 83 to be engaged with an engagement hook 811 of an operating button 81 of a plate locking means 8 as mentioned above is formed on the lower surface thereof.

Figure 10:
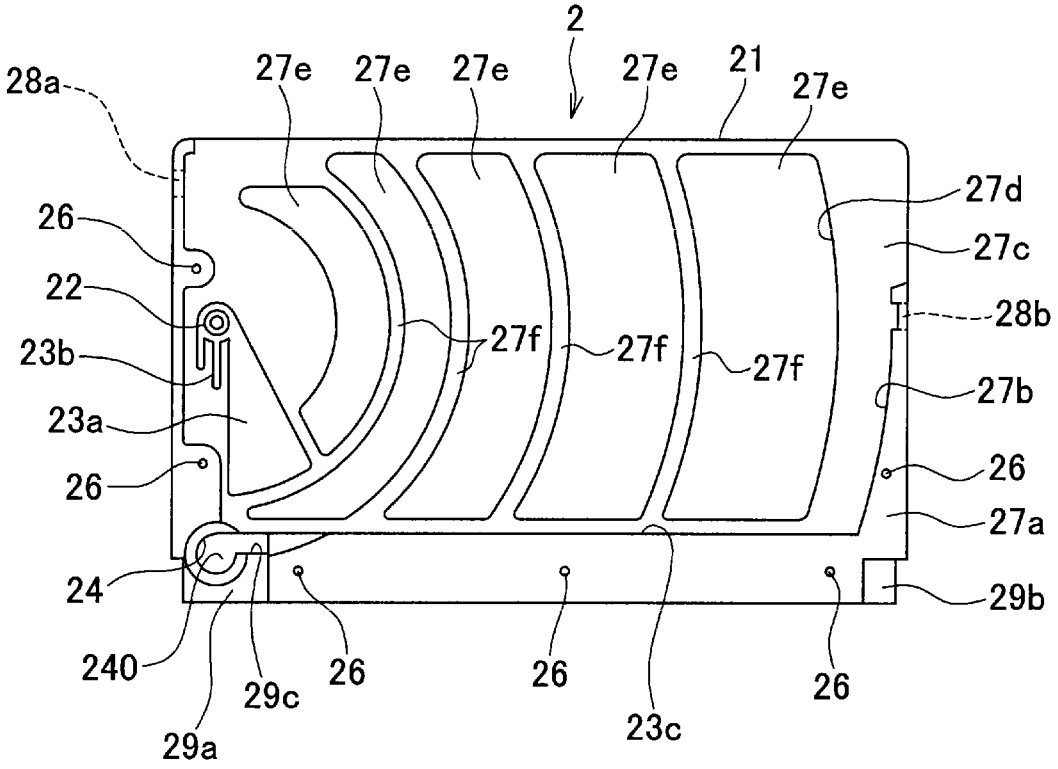
FIG. 10 is a plan view of a bottom plate of a business card case/name card case according to the invention.

In the following, a structure of a bottom plate 2 is described. A first stepped portion 27*b* is provided between an upper step surface 27*a* and a middle step surface 27*c* on an inner surface side of the bottom plate 2, as shown in FIGS. 2, 10. The upper step surface 27*a* is brought into a close contact with a lower surface of a card accommodating frame body 4 as mentioned above, while a space of a gap equal to a height of a first stepped portion 27*b* is created between the middle step surface 27*c* and the card accommodating frame body 4, and a card discharging plate 3 is held inside the space in a manner such that it can rotatably move between a retreated position and an advanced position as mentioned above. The area in which the space communicates with the outside corresponds to a card discharging opening 101 as mentioned above.

In the meantime, a plurality of lower step surfaces 27*e* respectively demarcated in an arc shape are provided by providing a second stepped portion 27*d* in an area deeper than a middle step surface 27*c*; a plurality of bow-shaped rib portions 27*f* are formed by these lower step surfaces 27*e* in order to save weight of a bottom plate 2 and to facilitate a smooth rotatable sliding of a card discharging plate 3 in a horizontal direction.

A plate locking means 8 as mentioned above (see FIGS. 2, 7, 11 to 15; in the meantime, FIG. 13 is an explanatory view showing main components including a mounting position of the plate locking means 8 from below, and FIG. 15 an enlarged view of an operating button 81) has a function to lock a card discharging plate 3 when it is accommodated inside a case body 10; it comprises an operating button 81 partially protruding from the case body 10 and having an engagement hook 811 provided in an operating button insertion hole 415 provided on the case main body 11 so as to be non-rotatable and slidable in an axial direction; an elastic means 82 elastically provided between an inner bottom portion of the operating button insertion hole 415 and the operating button 81; and an engagement groove 83 formed on the card discharging plate 3. Here in an embodiment shown in the drawings, the inner bottom portion of the operating button insertion hole 415 refers to an inner bottom portion 240 of a plate locking means holding hole 24 on a bottom plate 2 just under the operating button insertion hole 415 provided on a card accommodating frame body 4.

Therefore, the plate locking means 8 in an embodiment shown in the drawings comprises an operating button 81 having an engagement hook 811, a compression spring urging the operating button 81 upward (downward in FIG. 13), and an engagement groove 83 provided on the card discharging plate 3.

When a card discharging plate 3 is placed at a retreated position as mentioned above in an ordinary condition, an operating button 81 is urged by a compression spring 82, so that an engagement hook 811 on the operating button 81 keeps an engagement with an engagement groove 83 of the card discharging plate 3, and thereby the card discharging plate 3 is locked to remain in its retreated position.

On the other hand, a top portion 815 is pressed for discharging a card against an urging force of a compression spring 82 as mentioned above, so that an engagement hook 811 is released from an engagement groove 83 and unlocked; thus a card discharging plate 3 rotatably moves by an urging force of a spring 7 as mentioned above in a horizontal direction toward an advanced position as mentioned above.

In the meantime, an operating button 81 can be so designed that it can be locked and unlocked by sliding in a transverse direction or by rotating around the axis, besides being slidable in an axial direction. Further various arrangements are acceptable.

In assembling a rotatable movement mechanism, a plate locking means 8 and others of a card discharging plate 3, a spring 7 for rotatably moving the card discharging plate 3 and the plate locking means 8 are first placed on a bottom plate 2, and the card discharging plate 3 is mounted to cover it (see mainly FIG. 2).

Figure 14:
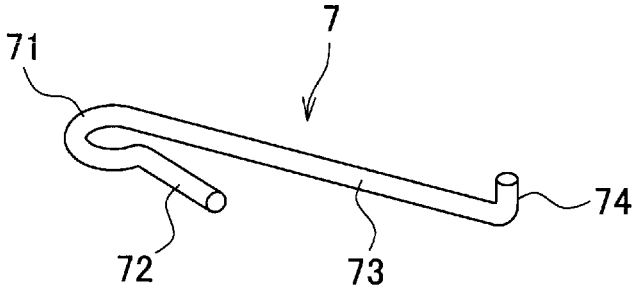
FIG. 14 is an enlarged perspective view of a spring as elastic means for urging a card discharging plate of a business card case/name card case according to the invention.

In other words, a spring 7 is placed by attaching a bend portion 71 thereof to a root portion of a pivot 22 provided on one short side of a bottom plate 2, in a manner such that a working arm 73 of the spring 7 is accommodated in a spring accommodating concave portion 23*a* of the bottom plate 2, while a stopper arm 72 is accommodated in a spring accommodating concave portion 23*b* (see FIGS. 2, 10, 14). As described below, a working end portion 74 bent upward being a tip of a working arm 73 of the spring 7 protrudes upward from a middle step surface 27*c* of the bottom plate 2 as described below formed on one short side of a card discharging plate 3, and is brought into a press contact with a spring working end surface 318 as described below, so that it movably urges a card discharging plate 3 toward an advanced position thereof.

Moreover, a compression spring 82 and an operating button 81 of a plate locking means 8 are fitted into a plate locking means holding hole 24 provided on a corner portion of a bottom plate 2. Namely, the plate locking means 8 is constructed by covering a compression spring 82 fitted into the plate locking means holding hole 24 with the operating button 81, in a manner such that a spring force of the compression spring 82 works between an inner bottom surface 240 of the plate locking means holding hole 24 and an inner surface of a top portion 815 of the operating button 81.

Thereupon, a pivotally supporting hole 315 provided on one short side of a card discharging plate 3 is fitted with a pivot 22 as mentioned above of a bottom plate 2, and the card discharging plate 3 is so placed that it overlaps the bottom plate 2. At this point, a working end portion 74 of a spring 7 is brought into a press contact with a spring working end surface 318 of a card discharging plate 3 as mentioned above, in a manner such that the working end portion 74 of the spring 7 works on the spring working end surface 318; still further, a card accommodating frame body 4 is superposed on it, and then the card accommodating frame body 4 is fixed to the bottom plate 2. In other words, the card accommodating frame body 4 is fixed to the bottom plate 2 by fastening a plurality of retaining screws 423 using a plurality of screw holes 418 provided on respective frame portions of the card accommodating frame body 4 and a plurality of screw holes 46 provided on an edge portion of the bottom plate 2. At this point, the card accommodating frame body 4 is so fixed to the bottom plate 2 that a head portion of an operating button 81 of a plate locking means 8 is inserted into an operating button insertion hole 415 provided on a corner portion of the card accommodating frame body 4.

Moreover, a detent projecting portion 816 of an operating button 81 is so designed that it is placed into a gap between a side surface 29*c* of a positioning convex portion 29*a* of a bottom plate 2 and a side surface 422*c* facing a positioning convex portion 422*c* of a card accommodating frame body 4, and the card accommodating frame body 4 is thus fixed to the bottom plate 2; in this manner, rotation of the operating button 81 around the axis can be prevented (detent) after completion of assembly.

In the meantime, when a card accommodating frame body 4 is fixed to a bottom plate 2, an engagement hook 811 of an operating button 81 of a plate locking means 8 is not necessarily engaged with an engagement groove 83 formed on a projecting portion 317 with an engagement groove of a card discharging plate 3 (in a state in which the card discharging plate 3 totally overlaps the bottom plate 2, and the card discharging plate totally retreats between the bottom plate 2 and the card accommodating frame body 4), but there is no problem with being engaged.

Upon fixing a card accommodating frame body 4 to a bottom plate 2 in an above-described manner, a lid body 5 is hinged on the bottom plate 2 so as to be openable/closable. In other words, the lid body 5 is mounted on the bottom plate 2 so as to be openable/closable, by inserting and fixing hinge means 6*a*, 6*b* into opening/closing pivotally supporting holes 516 as mentioned above of the lid body 5 and lid body mounting pin holes 25 of the bottom plate 2.

In the following, operation and effect of the card case 1 according to the invention are described.

The card case 1 according to the invention has a thin and compact structure as shown in the drawings, and is capable of accommodating approximately seven to sixteen cards inside the above-mentioned card accommodating frame body 4.

In other words, the card accommodating frame body 4 rotatably moves in a horizontal direction, and the spring 7 being a drive power source operates on a horizontal plane, so that the card case is capable of having an overall thin and compact structure.

Moreover, when the card case 1 is carried about, a plurality of cards M are accommodated in the card accommodating frame body 4, wholly covered with the lid body 5, and not exposed to the outside until they are brought out by the above-mentioned card discharging plate 3. Therefore, the cards are prevented from damages and well protected.

When the cards are accommodated in the card case 1, the lid body 5 of the card case 1 is opened, and a plurality of (approximately seven to sixteen) cards M are inserted into the card accommodating frame body 4.

When the cards are discharged, a simple operation of only pressing the operating button 81 of the above-mentioned plate locking means 8 enables to promptly bring out cards, with one card being respectively placed on the card discharging plate 3.

In the following, an operation of the card discharging plate 3 and the plate locking means 8 is described with reference to FIGS. 11, 12 and 13.

Figure 11:
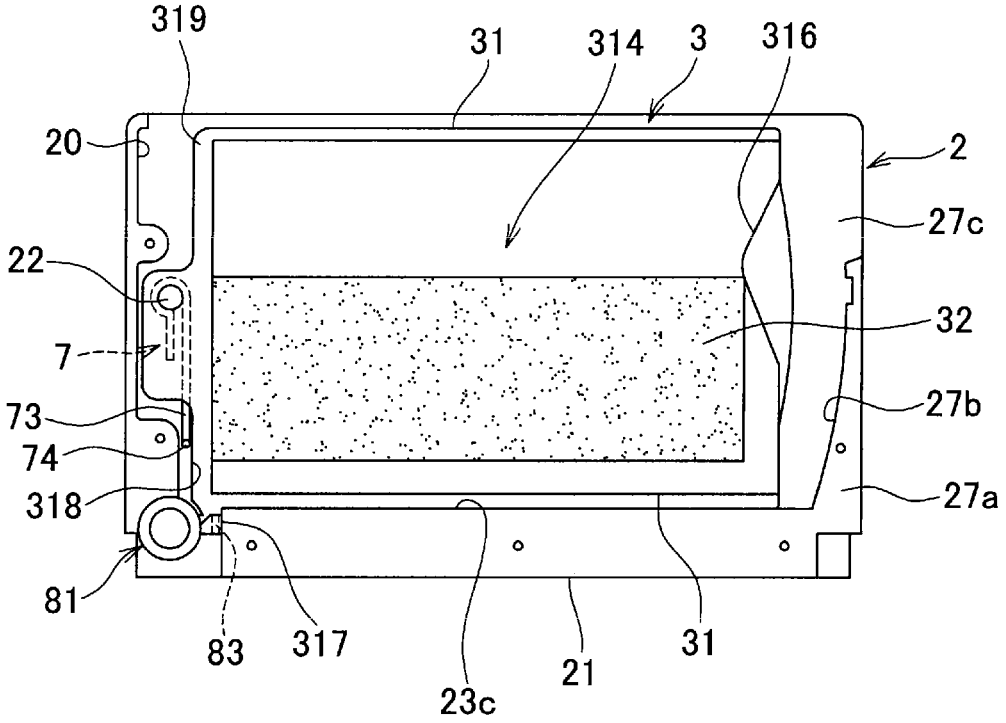
FIG. 11 is a plan view showing a card discharging plate of a business card case/name card case according to the invention being accommodated in a case body, so that the card discharging plate totally overlaps a bottom plate.

FIGS. 11 and 13A show the card discharging plate 3 totally overlapping the bottom plate 2 and held in the above-mentioned retreated position.

Figure 13:
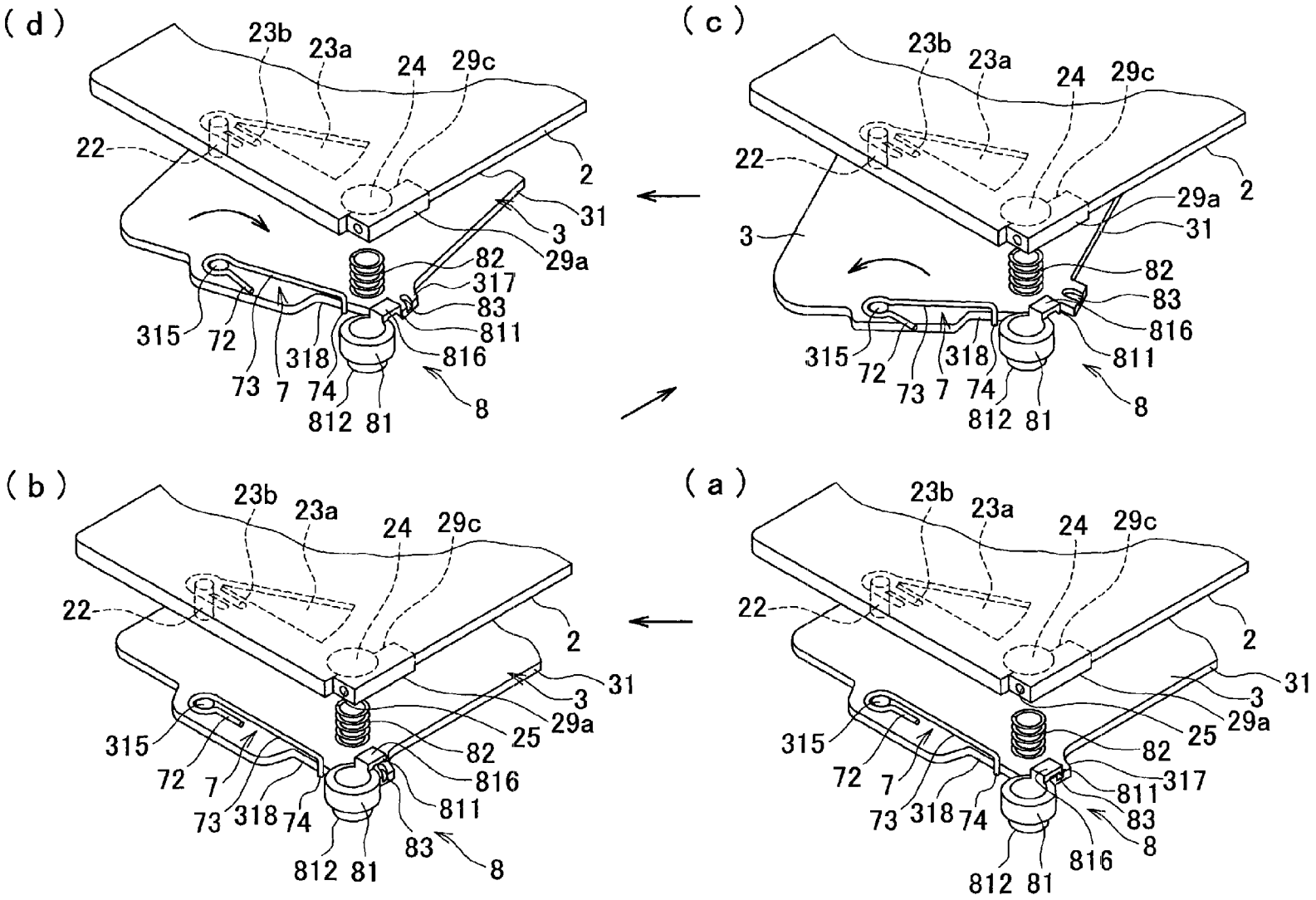
FIG. 13 is an explanatory view of main parts of a plate locking means of a card discharging plate of a business card case/name card case according to the invention as seen below, for illustrating an operation of the plate locking means.

At this point, the compression spring 82 and the operating button 81 are so placed that they are fitted into the plate locking means holding hole 24 of the bottom plate 2 as shown in FIG. 13A, the engagement hook 811 of the operating button 81 is engaged with the engagement groove 83 of the card discharging plate 3, the above-mentioned engagement state (locking state) is kept by the state of the operating button 81 in which it is pushed upward (downward in FIG. 13) by lifting force of the operating button 81.

In other words, the bending stress is accumulated in the spring 7 pivotally supported by the above-mentioned pivot 22 of the bottom plate 2 (see FIG. 11 in addition), and the working end portion 74 at the tip thereof works on the spring working end surface 318 of the card discharging plate 3 in this state, in order to cause the card discharging plate 3 to rotatably move around the pivot 22 in counter-clockwise direction in the drawing; due to the locking state however, wherein the engagement hook 811 is engaged with the engagement groove 83, the above-mentioned rotatable movement is prevented.

In the meantime, the operating button 81 is so designed that the stepped portion 813 thereof (see FIG. 15) is blocked by the stepped stopper 415*b* (see FIG. 7) of the operating button insertion hole 415 (see FIG. 7) of the card accommodating frame body 4, so as not to proceed further (upward).

Figure 12:
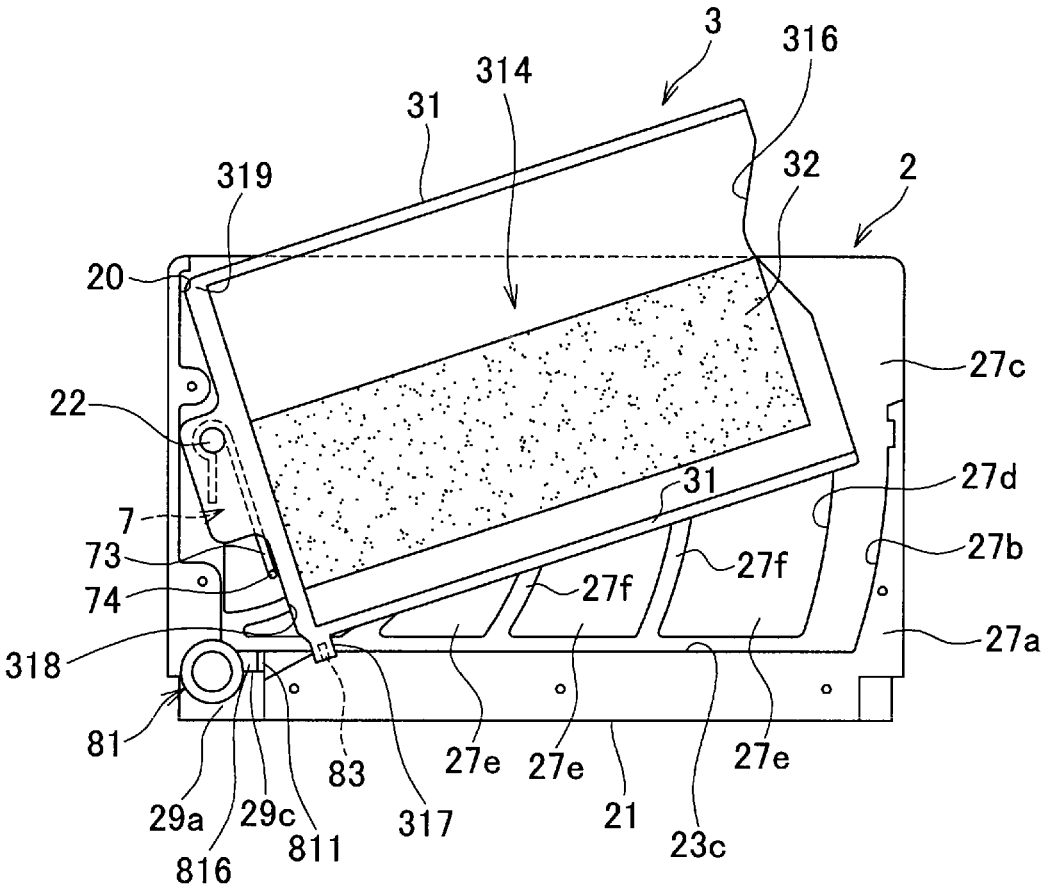
FIG. 12 is a plan view showing a part of a card discharging plate of a business card case/name card case according to the invention being exposed to the outside of a case body, so that a card on the card discharging plate can be discharged.

Next, when the top portion 815 of the operating button 81 is pressed by finger against the spring force of the above-mentioned compression spring 82 as shown in FIG. 13B for discharging the card, the engagement hook 811 of the operating button 81 is released from the engagement groove 83, so that the card discharging plate 3 rotatably moves by the urging force of the spring 7 around the pivotally supporting hole 315 (the pivot 22) in counter-clockwise direction in the drawing, and is displaced to the above-mentioned advanced position, as shown in FIGS. 13C and 12; in this manner, it is possible to discharge cards, as shown in FIGS. 3B, 4B and 12.

In the meantime, the card discharging plate 3 rotates at a predetermined angle and one corner portion 319 thereof comes into contact with the circumferential wall inner surface 20 in vicinity of one corner portion of the bottom plate 2, so that a further rotatable movement of the card discharging plate 3 is prevented as shown in FIG. 12; in this case the above-mentioned circumferential wall inner surface 20 serves as a stopper. This card discharging plate 3 is designed so as not to rotate at an angle exceeding a predetermined angle (20° in the embodiment), and this arrangement is needed to smoothly place the next card m onto the card discharging plate 3, since the card m is always pressured by the card pressing means 52*a* and 52*c* toward the card discharging plate 3.

In order to place the card discharging plate 3 back to the original retreated position after the card is brought out, the card discharging plate 3 as advanced is pushed back by finger, so that it is forced to rotatably move around the pivotally supporting hole 315 (the pivot 22) in clockwise direction. When the card discharging plate 3 approaches to the original retreated position, the engagement hook 811 of the operating button 81 is pushed down (pushed up in FIG. 13) by the outer circumferential surface of the projecting portion 317 with the engagement groove provided on the card discharging plate 3; when the card discharging plate 3 is further pushed inward, the engagement hook 811 is engaged with the engagement groove 83, and at the same time the side portion 31 thereof is brought into contact with the inner side portion 23*c* of the bottom plate 2, thus the card discharging plate 3 restores the original retreated position as shown in FIGS. 13A and 11.

In the meantime, the present invention is not limited to the above-described embodiments.

Namely, for example opening/closing method of the lid body 5 is not limited to a vertically rotating method as shown in embodiments shown in the drawings, but a horizontal sliding is also acceptable.

The card pressing means 52*a*, 52*b*, 52*c* can be also provided on the above-mentioned card accommodating frame body 4 itself, besides installation thereof on the inner surface of the lid body 5. The mounting position thereof is thus not limited.

Moreover, the card discharging plate 3 can adopt a linear sliding method in a traverse or vertical direction, and the movement is not limited to the rotatable movement method as mentioned above.

Still further, various materials other than felt can serve as anti-slip sheet attached to the top surface of the card discharging plate 3. Instead of the use of an anti-slip sheet, the top surface of the card discharging plate 3 itself can be also provided with fine irregularities, so that it has an anti-slip effect.

Still further, the above-mentioned plate locking means 8 can undergo diverse design changes: for example, the operating button can be so designed that it can be locked and unlocked by sliding in a transverse direction or by rotating around the axis, besides being slidable in an axial direction. Further various arrangements are acceptable.

Therefore, the invention encompasses any variant which can be easily conceived by the person skilled in the art, starting from the foregoing description, within the scope of an intended purpose thereof.

The present invention designed as in the foregoing is favorably used as the one capable of automatically and promptly discharging cards one by one, which is thin and space-saving, capable of assuring satisfactory protection for the cards as well as of giving the user's own strong impression to those given the cards.

What is claimed is:

1. A card case comprising:

a case main body comprising at least two side portions, a bottom plate and a card accommodating frame body having a hollow portion capable of accommodating plurality of cards inside and mounted on said bottom plate;

a lid body comprising at least two side portions, said lid body mounted to be able to open and close said case main body, said lid body further comprising a lid body locking means for locking said lid body in a closed state with regard to said case main body, said lid body locking means comprising a pair of engagement projecting pieces which are individually accommodated into a pair of component accommodating holes formed on both side portions of said case main body, a pair of compression springs individually accommodated into said component accommodating holes for pressing said engagement projecting pieces in outside directions, and a pair of engagement holes individually formed on both side portions of said lid body;

a card discharging plate swingably mounted on said bottom plate so as to proceed from and retreat into said case main body via a card discharging opening provided on a side portion of said case main body, with a card being placed on an upper surface thereof;

a card pressing means for pressing cards stored in said case main body toward said card discharging plate;

an elastic means for movably urging said card discharging plate in proceeding direction from said case main body; and a plate locking means comprising an operating button partially protruding from said lid body and having an engagement hook provided in an operating button insertion hole provided on said case main body so as to be non-rotatable and slidable in an axial direction, an elastic means resiliently provided between an inner bottom portion of said operating button insertion hole and said operating button, and an engagement groove formed on said card discharging plate in order to be engaged with said engagement hook when said card discharging plate is retreated into said case main body.

2. The card case according to claim 1, wherein said each of said card pressing means comprises a spring and a mounting plate fixing an end thereof to said lid body.

3. The card case according to claim 1, wherein an anti-slip sheet is attached to at least a part of an upper surface side of said card discharging plate.

* * * * *